US011737534B2

(12) United States Patent
Rodriguez

(10) Patent No.: US 11,737,534 B2
(45) Date of Patent: Aug. 29, 2023

(54) BADGE AND CREDIT CARD HOLDER

(71) Applicant: Louis Antonio Rodriguez, Miami, FL (US)

(72) Inventor: Louis Antonio Rodriguez, Miami, FL (US)

( * ) Notice: Subject to any disclaimer, the term of this patent is extended or adjusted under 35 U.S.C. 154(b) by 600 days.

(21) Appl. No.: 17/003,022

(22) Filed: Aug. 26, 2020

(65) Prior Publication Data

US 2022/0061485 A1 Mar. 3, 2022

(51) Int. Cl.

| | |
|---|---|
| ***A45C 11/18*** | (2006.01) |
| ***A45C 1/06*** | (2006.01) |
| ***G09F 3/20*** | (2006.01) |

(52) U.S. Cl.

CPC ..... *A45C 11/182* (2013.01); *A45C 1/06* (2013.01); *G09F 3/201* (2013.01); *A45C 2001/065* (2013.01); *A45C 2001/067* (2013.01); *A45F 2200/055* (2013.01)

(58) Field of Classification Search

CPC ... A45C 11/182; A45C 1/06; A45C 2001/065; A45C 11/18; A45C 2001/067; A45F 2200/055; G09F 3/207; G09F 3/201

USPC ..... 150/145–147; 206/39.4, 39

See application file for complete search history.

(56) References Cited

U.S. PATENT DOCUMENTS

| | | | | |
|---|---|---|---|---|
| 11,344,091 | B2 * | 5/2022 | Goodwin | A45C 13/185 |
| 2014/0014676 | A1 * | 1/2014 | Minson | A45C 11/182 221/226 |
| 2015/0335118 | A1 * | 11/2015 | Van Geer | A45C 11/182 150/147 |
| 2018/0310681 | A1 * | 11/2018 | Wingerter | B42F 17/32 |
| 2018/0338593 | A1 * | 11/2018 | Scharnigg | B65D 83/08 |
| 2019/0387853 | A1 * | 12/2019 | Chan | A45C 11/18 |
| 2020/0178657 | A1 * | 6/2020 | Van Geer | A45C 11/182 |
| 2020/0315308 | A1 * | 10/2020 | Van Geer | B65D 83/08 |
| 2021/0219685 | A1 * | 7/2021 | Van Geer | A45C 11/182 |
| 2021/0378375 | A1 * | 12/2021 | Elggren | A45C 11/182 |

* cited by examiner

*Primary Examiner* — Cassandra Davis

(74) *Attorney, Agent, or Firm* — Ruben Alcoba, Esq.

(57) ABSTRACT

A badge and credit card holder that is used to place a plurality of credit cards. The badge and credit card holder defines a badge that is permanently affixed to the badge and credit card holder. The badge and credit card holder defines an open top wherein credit cards can be dispensed from. The bottom of the credit card holder defines a linear slide spring mechanism that swivels an inner L-shaped lever. The L-shaped lever is designed to dispense credit cards in a staggered manner when the linear slide spring mechanism is used to push a lower end of the L-shaped lever. When the linear slide spring mechanism is pushed, the L-shaped lever pushes the plurality of credit cards upwards. The linear slide spring mechanism returns to a rest position after the user eliminates the force used to push the lower end of the L-shaped lever.

4 Claims, 4 Drawing Sheets

BADGE AND CREDIT CARD HOLDER

TECHNICAL FIELD

The present invention pertains to an improved badge and credit card holder.

BACKGROUND

The present invention is directed to a badge and credit card holder that uses a linear resistance mechanism to semi-automatically dispense the cards in a staggered manner.

The inventor of the present invention was an experienced law enforcement officer that realized the need of having a badge holder that could also hold at least a couple of credit cards.

He is aware of credit card holders that are presently in the industry, yet none are designed to hold a police or government issued badge and that use linear resistance mechanism to dispense the cards in a gentle, staggered and semi-automatic controlled manner.

The badge and credit card holder of the present invention resolves the need of having a government badge holder that is also a semi-automatic credit card dispenser.

SUMMARY

The present invention is directed to a government badge and credit card holder.

The badge and credit card holder defines a badge that is permanently affixed to the badge and credit card holder. The badge and credit card holder defines an open top wherein credit cards can be dispensed from. The bottom of the credit card holder defines a linear slide spring mechanism that swivels an inner L-shaped lever. The L-shaped lever is designed to dispense credit cards in a staggered manner when the linear slide spring mechanism is used to push a lower end of the L-shaped lever. When the linear slide spring mechanism is pushed, the L-shaped lever pushes the plurality of credit cards upwards. The linear slide spring mechanism returns to a rest position after the user eliminates the force used to push the lower end of the L-shaped lever. An upper end of the L-shaped lever defines a plurality of steps that stagger the plurality of credit cards when they are pushed upwards.

Preferred embodiments of the present invention shall be made of metallic materials.

An object of the present invention is to provide a badge and card holder that will eliminate the use of a separate badge holder.

Another object of the present invention is to provide a badge and card holder that will dispense credit cards in a staggered and controlled manner.

Still a further object of the present invention is to provide a badge and card holder that allows a government issued badge to be permanently affixed to a card dispensing device.

Yet still a further object of the present invention is to provide a badge and card holder that will not malfunction, for a linear spring mechanism has fewer moving parts than other mechanisms presently used to dispense credit cards from credit card holders.

DRAWINGS

These and other features, aspects, and advantages of the present invention will become better understood with regards to the following description, appended claims, and drawings where:

DESCRIPTION

Figure 1:
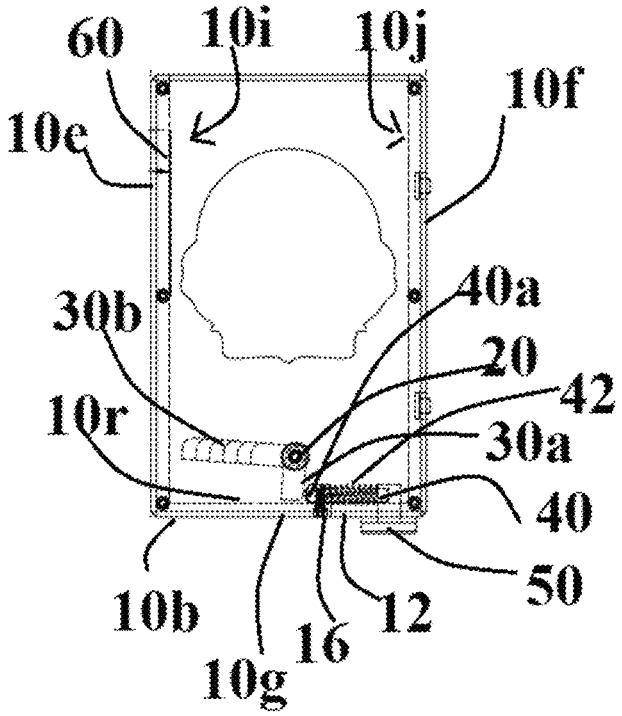
FIG. 1 is an open top plan view of the present invention that shows the inner elements of the invention.
Figure 2:
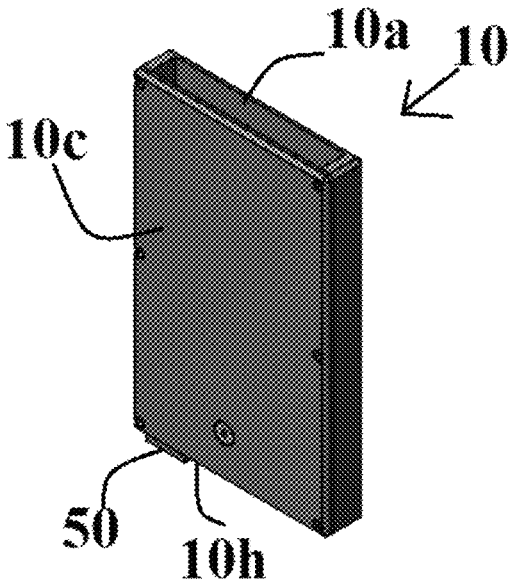
FIG. 2 is perspective view of one of the housing of the present invention.
Figure 3:
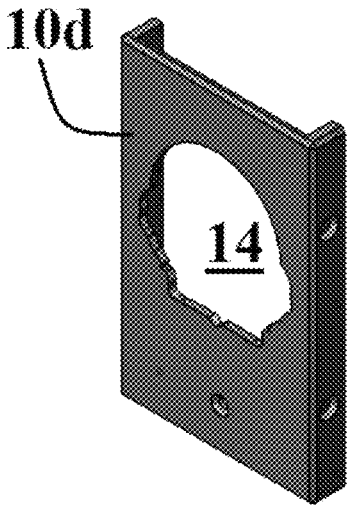
FIG. 3 is a perspective view of the other side of the present invention.
Figure 4:
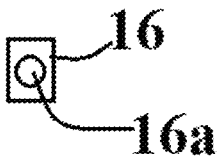
FIG. 4 is view of the pin guide of the present invention that highlights a central aperture of the pin guide.
Figure 5:
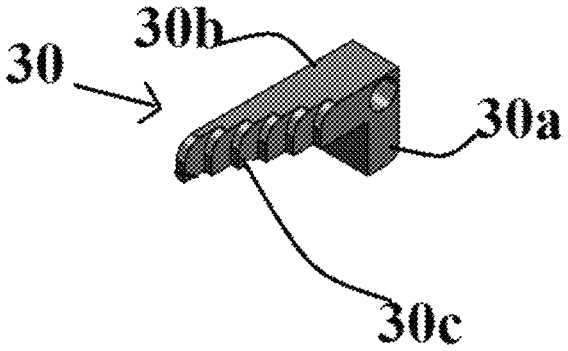
FIG. 5 is a perspective view of the L-shaped lever of the present invention.
Figure 6:
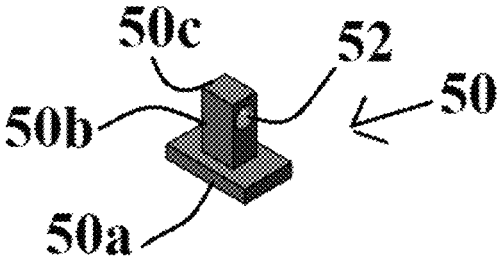
FIG. 6 is a perspective view of the button of the present invention.
Figure 7:
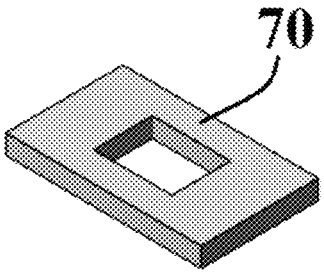
FIG. 7 is a perspective view of the synthetic resin material pad of the present invention.
Figure 8:
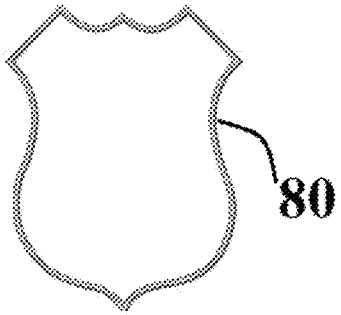
FIG. 8 is a front view of a badge.

Referring to FIGS. 1-8, the present invention is a badge and credit card holder. The badge and credit card holder comprise of a rectangular hollow cuboid 10 that defines an opening on a top side 10*a*, a linear slide aperture 12 on a bottom side 10*b*, and a badge aperture 14 on either a front side 10*c* or a rear side 10*d*. A pin guide 16 that defines a central aperture 16*a* is defined on an inner bottom side 10*r* of the rectangular hollow cuboid 10. A pivot 20 is secured to the front side 10*c* and to the rear side 10*d* of the of the rectangular cuboid 10, the pivot 20 is positioned between a left 10*e* and a right side 10*f* of the rectangular hollow cuboid 10, the pin guide 16 is in a position that is either to the left side 10*e* or the right side 10*f* from a bottom middle position 10*g* of the rectangular hollow cuboid 10, the linear slide aperture 12 is positioned between the pin guide 16 and either the left side 10*e* or right side 10*f* of the rectangular hollow cuboid 10. An L-shaped lever 30 that has a short end 30*a* and a long end 30*b* is attached on the pivot 20, the L-shaped lever 30 defines a plurality of steps 30*c* and the short end 30*a* of the L-shaped lever 30 points toward the inner bottom side 10*r* of the rectangular hollow cuboid 10. A pin 40 that holds a resistance spring 42 is placed within the central aperture 16*a* of the pin guide 16 and the pin 40 is capped with a cap 40*a* that holds the pin 40 within the pin guide 16. A button 50 that has a top 50*a*, a shaft 50*b* and a bottom 50*c*, a bottom of the shaft 50*b* of the button defines an aperture 52 that is attached to an end of the pin 40 that is not capped, the shaft 50*b* of the button 50 is placed within the linear slide aperture 12 and the top of the button 50*a* defines a head 50*a* that lies at a portion that is outside 10*h* of the rectangular hollow cuboid. And, a felt cloth 60 that is attached to either a left inner side 10*i* or a right inner side 10*j* of the rectangular hollow cuboid 10.

In an embodiment of the present invention, the badge and credit card holder will further comprise of a synthetic resin material pad 70 that mounts on the shaft 50*b* of the button 50 and that is placed between the head 50*a* of the button 50 and the outside of the bottom 10*h* rectangular hollow cuboid 10.

In preferred embodiments of the present invention, the badge and credit card holder is made of a metallic material and a badge 80 is placed to rest within the badge aperture 14 and the badge 80 is permanently affixed to the rectangular hollow cuboid 10.

In preferred embodiments of the present invention, there is a distance measured from the left side to the right side of the rectangular hollow cuboid of 2.50 inches, wherein there is a distance measured from the bottom side to the top side of the rectangular hollow cuboid of 4.00 inches, and wherein there is a distance measured from the front side to the rear side of the rectangular hollow cuboid of 0.41 of an inch.

An advantage of the present invention is that it provides a badge and card holder that eliminates the use of a separate badge holder.

Another advantage of the present invention is that it provides a badge and card holder that dispenses credit cards in a staggered and controlled manner.

Still a further advantage of the present invention is that it provides a badge and card holder that allows a government issued badge to be permanently affixed to a card dispensing device.

Yet still a further advantage of the present invention is that it provides a badge and card holder that will not malfunction.

The embodiments of the badge and credit card holder described herein are exemplary and numerous modifications, combinations, variations, and rearrangements can be readily envisioned to achieve an equivalent result, all of which are intended to be embraced within the scope of the appended claims. Further, nothing in the above-provided discussions of the badge and credit card holder should be construed as limiting the invention to an embodiment or a combination of embodiments. The scope of the invention is defined by the appended claims.

What is claimed is:

1. A badge and credit card holder, the badge and credit card holder comprises:

a rectangular hollow cuboid that defines an opening on a top side, a linear slide aperture on a bottom side, and a badge aperture on either a front side or a rear side;

a pin guide that defines a central aperture is defined on an inner bottom side of the rectangular hollow cuboid;

a pivot is secured to the front side and to the rear side of the of the rectangular cuboid, the pivot is positioned between a left and a right side of the rectangular hollow cuboid, the pin guide is in a position that is either to the left side or the right side from a middle bottom position of the rectangular hollow cuboid, the linear slide aperture is positioned between the pin guide and either the left side or right side of the rectangular hollow cuboid;

an L-shaped lever that has a short and a long end is attached on the pivot, the L-shaped lever defines a plurality of steps and the short end of the L-shaped lever points toward the inner bottom side of the rectangular hollow cuboid;

a pin that holds a resistance spring is placed within the central aperture of the pin guide and the pin is capped with a cap that holds the pin within the pin guide;

a button that has a top, a shaft and a bottom, the bottom of the button defines an aperture that is attached to an end of the pin that is not capped, the shaft of the button is placed within the slide aperture and the top of the button defines a head that lies at a position that is outside of the rectangular hollow cuboid; and a felt cloth is attached to either a left inner side or a right inner side of the rectangular hollow cuboid.

2. The badge and credit card holder of claim 1, the badge and credit card holder comprises of a synthetic resin material pad that mounts on the shaft of the button and that is placed between the head of the button and the outside of the bottom rectangular hollow cuboid.

3. The badge and credit card holder of claim 1, wherein the badge and credit card holder is made of a metallic material and a badge is placed to rest within the badge aperture and the badge is permanently affixed to the rectangular hollow cuboid.

4. The badge and credit card holder of claim 1, wherein there is a distance measured from the left side to the right side of the rectangular hollow cuboid of 2.50 inches, wherein there is a distance measured from the bottom side to the top side of the rectangular hollow cuboid of 4.00 inches, and wherein there is a distance measured from the front side to the rear side of the rectangular hollow cuboid of 0.41 of an inch.

* * * * *